United States Patent [19]

De Jong et al.

[11] Patent Number: 4,929,374

[45] Date of Patent: May 29, 1990

[54] LUBRICATING OIL COMPOSITION

[75] Inventors: Feike De Jong; Willem Dannenberg; Jacob Vermeule, all of Amsterdam, Netherlands

[73] Assignee: Shell Oil Company, Houston, Tex.

[21] Appl. No.: 229,202

[22] Filed: Aug. 8, 1988

[30] Foreign Application Priority Data

Sep. 22, 1987 [GB] United Kingdom ..... 8722323

[51] Int. Cl.[5] ..... C10M 133/16

[52] U.S. Cl. ..... 252/39

[58] Field of Search ..... 252/38, 39, 51.5 A

[56] References Cited

U.S. PATENT DOCUMENTS

| | | | |
|---|---|---|---|
| 3,172,892 | 3/1965 | Le Suer et al. | 260/326.5 |
| 3,231,587 | 1/1966 | Rense | 260/346.8 |
| 3,346,493 | 10/1967 | Le Suer | 252/39 |
| 3,704,315 | 11/1972 | Strang | 252/39 |
| 3,711,406 | 1/1973 | Lowe | 252/33.4 |
| 3,761,404 | 9/1973 | Calow | 252/39 |
| 3,903,003 | 9/1975 | Murphy et al. | 252/51.5 |
| 3,912,764 | 10/1975 | Palmer, Jr. | 260/346.8 |
| 3,965,017 | 6/1976 | Burnop et al. | 252/33.3 |
| 4,278,555 | 7/1981 | Zaweski et al. | 252/52 A |
| 4,493,776 | 7/1981 | Rhodes | 252/25 |

FOREIGN PATENT DOCUMENTS

| | | | |
|---|---|---|---|
| 0844481 | 6/1970 | Canada | 8/87 |
| 031990 | 7/1981 | European Pat. Off. . | |
| 32008 | 7/1981 | European Pat. Off. . | |
| 208560 | 1/1987 | European Pat. Off. . | |
| 2145698 | 9/1970 | Fed. Rep. of Germany | 252/39 |
| 1569519 | 6/1967 | France | 252/39 |
| 2094182 | 6/1971 | France . | |
| 2263253 | 3/1975 | France . | |
| 1146925 | 3/1969 | United Kingdom | 252/39 |
| 2066828 | 5/1981 | United Kingdom . | |

*Primary Examiner*—William R. Dixon, Jr.
*Assistant Examiner*—James M. Hunter, Jr.

[57] ABSTRACT

Lubricating oil composition comprising a lubricating base oil, one or more overbased alkaline earth metal salts of an aromatic carboxylic acid, a succinimide derivative being the reaction product of a hydrocarbyl-substituted succinic anhydride and an amine, and an anti-gelling agent which has been selected from a polyalkoxylated alcohol and an alkanolamine derivative.

16 Claims, No Drawings

LUBRICATING OIL COMPOSITION

FIELD OF THE INVENTION

The present invention relates to a lubricating oil composition comprising a lubricating base oil, one or more overbased metal salts of a carboxylic acid and an anti-gelling agent.

STATE OF THE ART

The use of oil-soluble overbased metal salts of carboxylic acids as detergent additives in lubricating oils is well known. The excess basicity of the salts not only improves the detergent properties of the oils but also provides the oils with an alkaline reserve which neutralizes any acidic compound which is formed during the operation of the engine in which the lubricating oil composition is used.

Solutions of oil-soluble overbased salts in a lubricating base oil sometimes have a tendency to gel. It is evident that this gelling tendency may lead to difficulties when such solutions are used in practice. This problem has been known in the art for a long time and in GB-A-818,325 a solution is proposed. This patent specification proposes to add an oil-soluble compound which contains a polar group to the composition. Examples of such compounds are mono- or polyhydric alcohols such as methanol, hexanol and decanol, alkylamines such as decylamine, alkyl phenol, alkyl aromatic carboxylic acids and hydrocarboxylic acids, aliphatic carboxylic acids, naphthenic acids, sulphonic acids, phosphoric acids and their salts. From the Examples in this reference it is apparent that considerable amounts of the anti-gelling agent are required to get the desired result, especially in the case of overbased alkaline earth metal salts. Further, the use of carboxylic acids thereof as anti-gelling agents, as is described in Examples of the British patent specification, reduces the overall basicity, calculated as the total equivalent of metal over the total equivalent of acid, thereby decreasing the desirable alkaline reserve. Hence these anti-gelling agents are not satisfactory.

Further, the gelling tendency of such compositions can even be increased when the lubricating oil composition also contains a succinimide derivative. Such succinimide derivatives are the reaction products of a hydrocarbyl-substituted succinic acid, such as an alkyl or alkenyl substituted succinic acid with an amine, in particular a polyamine. Processes to prepare such succinimide derivatives are e.g. described in US-A-3,172,892. The gelling occurring in lubricating oil compositions containing both an overbased salt and a succinmide derivative cannot be counteracted effectively by the anti-gelling agents mentioned in GB-A-818,325. Applicants have now found that other compounds which not necessarily have to fulfill the requirement set by GB-A-818,325, i.e. that they have a polar group and an oleophilic group, prevent gelling, even at low concentrations without reducing the alkaline reserve in solutions of overbased salts and succinimide derivatives.

SUMMARY OF THE INVENTION

Accordingly the present invention provides a lubricating oil composition comprising a lubricating base oil, one or more overbased alkaline earth metal salts of an aromatic carboxylic acid, a succinimide derivative, being the reaction product of a hydrocarbyl substituted succinic anhydride and an amine, and an anti-gelling agent, which has been selected from a polyalkoxylated alcohol and an alkanolamine derivative.

DETAILED DESCRIPTION OF THE INVENTION

The lubricating base oils present in the compositions of the invention are not critical. Preferably, hydrocarbon lubricating oils, which may be mineral or synthetic, are used but ester-type lubricating base oils and vegetable oils can also be used. The compositions can also contain mixtures of lubricating base oils. An example of such a mixture is a mixture of mineral lubricating oils, for instance a mixture of a distillate lubricating oil and residual lubricating oil. Another example of such a mixture is a mixture of a mineral lubricating oil and a synthetic hydrocarbon lubricating oil. As examples of suitable synthetic hydrocarbon lubricating oils can be mentioned polyolefins, such as polyisobutylenes. Preferably, the lubricating oil component of the compositions according to the invention is a mineral lubricating oil or a mixture of mineral lubricating oils. The viscosity of the lubricating oils present in the lubricating oil compositions can vary within wide ranges, and is generally from about 3 to about 100 cSt at 100° C.

Any conventional aromatic carboxylic acid can be used. Suitable aromatic carboxylic acids include acids containing a benzene or naphthalene ring and one or more oil-solubilising radicals having a total of at least 8, in particular at least 12 carbon atoms. Particularly preferred are alkyl salicylic acids having at least 10 carbon atoms in the alkyl group, in particular from 12 to 26 carbon atoms.

The alkaline earth metals used in the present composition include magnesium, calcium, strontium and barium. Preferably, the alkaline earth metal employed is magnesium, calcium or mixtures thereof. The preparation of overbased metal salts has been described in several patent documents, e.g. GB-A-786,167 and in applications Nos. 8627130 corresponding to copending U.S. Ser. No. 113,299 and European patent 248,465, the disclosures of which are incorporated herein by reference. In the present composition by an overbased metal salt is understood any salt in which the basicity index (BI), defined as the equivalent ratio of metal to aromatic carboxylic acid is greater than 1. The BI of the salt used is preferably from about 3 to about 20. By the term "overbased metal salt" is further understood any metal salt which before or after overbasing has been subjected to a further treatment, e.g. a sulphurization and/or boration step, such as those described in EP-A-0,168,110, EP-A-0,168,111, EP-A-0,168,880 and GB-B-2,149,810.

The succinimide derivative is the reaction product of a substituted succinic anhydride and an amine. Suitably, the amine is a polyamine having 3 to 25 carbon atoms and selected from linear and branched alkylene polyamines, cycloaliphatic polyamines and heterocyclic polyamines.

Suitable linear polyamines used in the reaction product of the present invention include the ethylene polyamines, but also $\alpha,\omega$-diaminopropane or butane, propylene polyamines, di(trimethylene) triamine, and butylene polyamines. Preferred are the ethylene polyamines, in particular diethylene triamine, triethylene tetramine, tetraethylene pentamine and pentaethylene hexamine.

Suitable branched polyamines include those of formula I

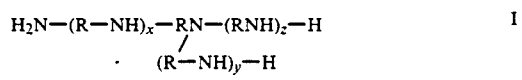

I in which R is a $C_{2-4}$ alkylene group, x is 0–7, y is 1–7, z is 0–7 and x+y+z is 1–8.

Cycloaliphatic polyamines are suitably selected from 5 or 6-membered ring systems, such as cyclopentane or cylcohexane rings. Amino groups may be attached directly to the rings. However, it is also possible that the rings are substituted by amino alkyl groups. A suitable cyclic polyamine is 1,4-diaminocyclohexane. Among suitable heterocyclic polyamines are tetra- and dihydro pyridines, piperadines, azetidines, pyrroles, piperazines, substituted by one or more amino, amino alkyl groups of formula II

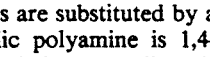

in which w is from 0–5 and R is a $C_{2-4}$ alkylene group. Especially preferred are N-(2-aminoethyl)piperazine and 1,4-bis(2-aminoethyl)-piperazine.

Ethylene polyamines as mentioned under the linear polyamines are especially useful in the present invention. Such compounds are prepared very conveniently by reacting an alkylene chloride with ammonia or by reacting ethylene imine with e.g. ammonia. These reactions result in a mixture of alkylene polyamines, including cyclic products such as piperazines.

The polyamines have advantageously a molecular structure consisting of $\text{+}N(R_2)—R_1\text{+}_a$ and/or

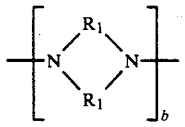

as the building blocks and $—R_1—NR_2R_3$ and/or

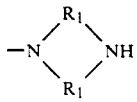

as the chain terminating groups, wherein $R_1$ is ethylene, propylene, trimethylene or a butylene group, $R_2$ and $R_3$ are hydrogen or $—R_1—NH_2$, a is 0 to 7 and b is 1 to 3.

The hydrocarbyl substituent at the succinic group is preferably derived from a polyolefin. It is suitably derived from a homopolymer or copolymer of one or more olefin monomers having 2 to 16 carbon atoms, preferably from 2 to 6 carbon atoms. The copolymers include random, block and tapered copolymers. Suitable monomers include ethene, propene, butenes, isobutene, pentenes, octenes, and also diolefines such as butadiene and isoprene. If a diene is used as monomer the resulting polymer is preferably hydrogenated to saturate at least 90%, more preferably substantially all unsaturated bonds. It is especially preferred to use an alkenyl substituent derived from polyisobutylene.

The number average molecular weight of the hydrocarbyl-substituent is preferably from about 600 to about 6000, more preferred from 750 to 3500.

The number average molecular weight (Mn) can easily be determined by vapour pressure osmometry or by gel permeation chromatography with calibration of the polymer, as will be appreciated by those skilled in the art. The weight average molecular weight (Mw) can also be determined by gel permeation chromatography. The quotient Mw/Mn, which is a measure indicating the width of molecular weight distribution, has usually a value from 1.5 to 4.0.

The number of succinic groups per hydrocarbyl moiety may be greater than 1. Preferably the number of succinic groups per hydrocarbyl moiety is from 1.0 to 4.0, in particular from 1.4 to 3.0.

The preparation of hydrocarbyl-substituted succinic anhydride is done in analogy to processes known in the art. To obtain the precursors of the succinimides used in the present invention one uses starting material with the required molecular weight and one uses an appropriate amount of the succinic anhydride precursor, i.e. generally maleic anhydride. In case a polyolefin is used as substituent substituted succinic anhydride can conveniently be prepared by mixing the polyolefin, e.g. polyisobutylene, with maleic anhydride and passing chlorine through the mixture yielding hydrochloric acid and alkenyl-substituted succinic anhydride, as described in e.g. GB-A-949,981 and corresponding U.S. Pat. No. 3,231,587.

Another method for preparation of substituted succinic anhydride is described in the above-mentioned US-A-3,172,892, according to which a halogenated, in particular chlorinated, polyolefin is reacted with maleic anhydride.

From e.g. NL-A-74 12 057 and corresponding GB1,483,729 is known to prepare hydrocarbyl-substituted succinic anhydride by reacting thermally a polyolefin with maleic anhydride. It is further possible to combine the methods of this Dutch application and GB-A-949,981, as is illustrated in GB-A-1,440,219 and corresponding U.S. Pat. No. 3,912,764. The products prepared in this way include compounds in which the alkenyl chain is connected to one or both of the alpha carbon atoms of the succinic group.

The reaction products of the hydrocarbyl-substituted succinic anhydride and the polyamine are obtained by heating them together, preferably at temperatures of at least 80° C., e.g. from 100° to 300° C. Most preferred are temperatures of 125° to 250° C. It is preferred that the number of succinic anhydride groups per polyamine group is greater than 1, so that two primary amine groups of at least some of the polyamines can react with a succinic anhydride group to yield a mixture of mono- and bis-succinimides. When the equivalent ratio of succinic anhydride groups and primary amine groups equals two, the reaction product will consist on average of bis-succinimides. When polyamines with two primary amine groups are used, such as linear ethylene polyamines use of more succinic groups may result in a reaction product which contains unreacted succinic anhydride groups or amido groups. The lubricating composition according to the present invention preferably contains succinimide additives which are the reaction product of 1.4 to 2.4 groups of succinic anhydride groups per polyamine group.

It is also possible to subject the hydrocarbyl-substituted succinimide to post-treatments. The invention therefore further provides lubricating composition comprising a major portion of a lubricating oil and a minor portion of an additive obtained by post-treating a hydrocarbyl-substituted succinimide as described above, which post-treating has been carried out by an agent selected from boron oxide, boron oxide hydrate, boron halides, boron acids, esters of boron acids, carbon disulphide, $H_2S$, sulphur, sulphur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorous oxides, phosphoric acid, hydrocarbyl thiocyanates, hydrocarbyl isocyanates, hydrocarbyl isothiocyanates, epoxides, episulphides, formaldehyde or formaldehyde-producing compounds plus phenols, and sulphur plus phenols.

The anti-gelling agent used according to the present invention can be a polyalkoxylated alcohol. The alcohol can be selected from aliphatic, cycloaliphatic, heterocyclic and aromatic alcohols. Suitable examples of alcohols include $C_{1-10}$ alkanols, diols such as glycol and propyleneglycol and triols, such as glycerol. Cyclohexanol and cyclopentanol are suitable cycloaliphatic alcohols. Suitable heterocyclic alcohols include hydroxygroup(s)-containing tetrahydrofuran and tetrahydropyran. The most preferred aromatic alcohol is phenol. Preferably, the alcohol is cyclic. These cyclic alcohols, like the aromatic, cylcoaliphatic and heterocyclic alcohols preferably contain oil-solubilizing radicals, such as a $C_{5-30}$, preferably $C_{8-12}$-alkyl or a $C_{7-30}$, preferably $C_{12-22}$ acyl group. Preferred alcohols are nonyl phenol and 2-[(1-hydroxy-2-oleyloxy)-ethyl]-3,4-dihydroxytetrahydrofuran.

The number of alkoxy groups in the polyalkoxylated alcohol may vary, and is chosen such that the compound is oil-soluble. Hence, when the alcohol is oil-soluble or almost oil-soluble, the number of alkoxy groups is preferably at least 2, whereas for the low-molecular weight alcohols the number of alkoxy groups will be chosen higher to render the compound oil-soluble. For alcohols which contain an oil-solubilizing radical as mentioned above, the number of alkoxy groups is preferably from 3 to 15. The preferred group is ethoxy, although other alkoxy groups such as propoxy, butoxy or pentoxy groups can also be used.

When the anti-gelling agent is an alkanolamine derivative, the derivative has preferably an oil-solubilizing radical, such as a $C_{5-30}$ alkyl or $C_{7-30}$ acyl group. It is emphasized that alkanolamines without such an oil-solubilizing radical can be used, too; e.g. triethanolamine is also very effective. The oil-solubilizing radical can be connected to the same nitrogen atom as to which the hydroxy alkyl moiety is attached. It is however, also possible to have a polyamine with one of the nitrogen atoms containing the hydroxy alkyl moiety or moieties and one other nitrogen atom attached to the oil-solubilizing radical. Since the compounds having more than one hydroxy alkyl moiety appear to be more effective, preference is given to compounds having at least two hydroxy alkyl moieties. When polyamines are used the compounds do not need to contain an oil-solubilizing radical. The alkanol amine is suitably an ethanol amine. Preferred examples of the alkanolamine derivatives are N-oleyl-diethanolamine, $C_{18}$-alkyl-2-hydroxy-benzyl-diethanolamine, $C_{18}$-alkyl-diethanol-amine, N-$C_{18}$-alkyl-N,N'N'-tri(2-hydroxyethyl)-1,3-diaminopropane, and 1,16-dihydroxy-3,7,10,14-tetra(2-hydroxyethyl)-3,7,10,14-tetra-azahexadecane. As is apparent from the structural

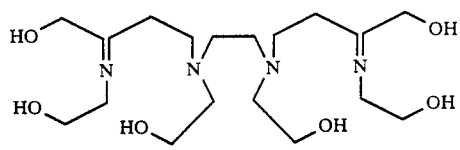

(I)

formula I of the latter compound, this compound contains six ethanolamine moieties.

Most preferred anti-gelling agents are those compounds in which the hydroxy-alkyl group of the alkanolamine derivative consists of a hydroxy(poly)alkoxyalkyl group, thereby combining the feature of having a combination of hydroxy and amino functions in one molecule on the one hand and of being a polyalkoxylated alcohol on the other. The amine is preferably a polyamine and there are preferably two hydroxyalkyl groups attached to one nitrogen atom in the anti-gelling molecule. The number of alkoxy groups, in particular ethoxy groups in these molecules advantageously ranges from 2 to 15. Suitable examples of alkoxylated alkanolamines are ethoxylated oleyl-diethanolamine containing 3 additional ethoxy groups and ethoxylated N,N-di(hydroxyethyl)-N',N'-dimethyl-1,3-diaminopropane, containing 3–8 ethoxy groups.

The lubricating oil composition according to the present invention may contain the anti-gelling agent in various amounts. Preferably, the composition contains from 0.05 to 6.0 %w of the anti-gelling agent. The amounts of the overbased salts and the succinimide derivative can also vary within wide ranges, dependent on the use of the lubricating oil composition. When the composition is used in marine lubricants the lubricating oil composition preferably contains from 0.5 to 20 %w of the overbased salt and from 0.5 to 20 %w of the succinimide derivative. In lubricating oil compositions for road engines the amount of the overbased salt is preferably from 0.5 to 5.0 %w and that of the succinimide derivative from 0.5 to 20 %w, all weight percentages being based on the weight of the lubricating base oil.

The lubricating composition according to the invention is suitably prepared by addition of an additives concentrate to a lubricating base oil. Such a concentrate generally comprises a lubricating base oil as solvent-/diluent and one or more additives in a concentrated form. Hence the present invention further provides a lubricating oil concentrate comprising a lubricating base oil, up to 80%w of a succinimide, up to 60%w of overbased salt, and from 0.5 to 10%w of the anti-gelling agent, all weight percentages based on the weight of the lubricating base oil.

The lubricating oil composition may further contain a number of other additives, such as antioxidants, foam inhibitors, corrosion inhibitors, viscosity index improvers, and pour point depressants, as can be established by a person skilled in the art.

The invention will be illustrated by means of the following Example.

EXAMPLES

The invention will be illustrated by means of the following Example, which should not be regarded as limiting the invention in any way.

EXAMPLE 1

The anti-gelling performance a number of compounds was tested in a lubricating oil composition containing the following components:

- a hydrocarbon mineral base oil having a kinematic viscosity at 100° C. of 4.4–4.9 $mm^2/s$;
- 2.1%w of an overbased calcium $C_{14-18}$ alkyl salicylate, having a basicity index of 8.0;
- 12.0%w of a succinimide derivative, prepared by a chlorine-mediated coupling of maleic anhydride (MALA) and polyisobutylene (PIB) to yield PIB(-MALA)$_{1.75}$, followed by a reaction with tetraethylenepentamine (TEPA) to yield a succinimide derivative having a molar ratio of succinic groups of TEPA of 2.2. This preparation was carried out in analogy to the process described in the British application No. 8628523 and corresponding U.S. Ser. No. 121,193; 0.4%w of the anti-gelling agent, all weight percentages based on the weight of the mineral base oil.

The kinematic viscosity of the mixture at 40° C. was determined both immediately after mixing the components and after storage of 6 days at 40° C.

The anti-gelling agent used and the results are indicated in the Table below.

TABLE

| Anti-gelling agent | $V_k$ at 40° C. ($mm^2/s$) initially | after 6 days |
|---|---|---|
| none | 810.7 | >10,000 |
| $C_{17}H_{33}C(O)NCH_2CH_2OH$ | 325.1 | 413.6 |
| p-$C_9H_{19}$—$C_6H_4O(CH_2CH_2O)_4H$ | 294.7 | 399.3 |
| $C_{18}H_{37}N(CH_2CH_2OH)_2$ | 275.1 | 345.7 |
| p-$C_9H_{19}$—$C_6H_4O(CH_2CH_2O)_{9.5}H$ | 261.8 | 312.9 |
| $C_{17}H_{33}C(O)N$ (ethoxylated) $(CH_2CH_2O)_xH$, $(CH_2CH_2O)_yH$, x + y = 5 | 255.5 | 307.5 |
| $C_{17}CO$ (O, OH, OH, OH) having 1–5 ethoxy groups | 274.2 | 304.5 |
| $C_{18}H_{37}N$ $(CH_2CH_2O)_xH$, $(CH_2CH_2O)_yH$, x + y = 5 | 244.3 | 288.1 |
| $C_{18}H_{37}N$ (N, OH, OH, OH) | 240.7 | 285.8 |
| $(CH_3)_2N$ N $(CH_2CH_2O)_xH$, $(CH_2CH_2O)_yH$, x + y = 10 | 208.7 | 226.3 |
| HO, HO, HO, N, N, N, N, OH, OH, OH | 210.1 | 211.3 |
| $(CH_3)_2N$ N $(CH_2CH_2O)_xH$, $(CH_2CH_2O)_yH$, x + y = 5.6 | 194.0 | 203.2 |

What is claimed is:

1. A lubricating oil composition comprising a lubricating base oil, an overbased alkaline earth metal salt of an alkyl salicylic acid in which the alkyl group has at least 8 carbon atoms, a succinimide derivative being the reaction product of a hydrocarbyl-substituted succinic anhydride and an amine, and an anti-gelling agent of an alkanolamine derivative.

2. The composition according to claim 1, in which the lubricating base oil is a mineral or synthetic hydrocarbon lubricating oil.

3. The composition according to claims 1 or 2, in which the alkaline earth metal is magnesium or calcium or mixtures thereof.

4. The composition according to claims 1 or 2, in which the succinimide derivative is the reaction product of a polyamine with 3 to 25 carbon atoms and a hydrocarbyl-substituted succinic anhydride.

5. The composition according to claim 1, in which the polyalkoxylated alcohol is polyethoxylated.

6. The composition according to claims 1 or 2, in which the anti-gelling agent is an alkanolamine derivative having an oil-solubilizing radical.

7. The composition according to claim 6, in which the alkanolamine is a polyamine derivative.

8. The composition according to claim 7, in which the alkanolamine derivative contains at least two hydroxyalkyl moieties.

9. The composition according to claim 8, in which the alkanolamine is an ethanol amine derivative.

10. The composition according to claims 1 or 2, in which the anti-gelling agent is a polyalkoxylated alkanolamine derivative.

11. The composition according to claim 10, in which the anti-gelling agent is a polyethoxylated alkanolamine derivative.

12. The composition according to claim 11, in which the number of alkoxy groups is from 2 to 15.

13. The composition according to claims 1 or 2, containing a lubricating base oil, from 0.5 to 20 w% of an overbased metal salt, from 0.5 to 20 w% of a succinimide derivative and from 0.05 to 6.0 w% of an anti-gelling agent, all weight percentages being based on the total weight of the lubricating base oil.

14. A lubricating oil concentrate comprising a lubricating base oil, up to 80 w% of an overbased metal alkyl salicylate in which the alkyl group has at least 8 carbon atoms, up to 60 w% of a succinimide derivative being the reaction product of a hydrocarbyl-substituted succinic anhydride and an amine and from 0.5 to 10 w% of an anti-gelling agent of an alkanolamine derivative, all weight percentages being based on the weight of the lubricating base oil.

15. The lubricating oil composition according to claims 1 or 2, wherein the overbased salt is magnesium, calcium or mixtures thereof salt of alkyl salicylic acid, the succinimide is of a polyamine and the anti-gelling agent is an alkanolamine.

16. The lubricating oil composition according to claim 15 wherein the alkanolamine is polyethoxylated.

* * * * *